United States Patent [19]

Matayoshi et al.

[11] 4,240,392

[45] Dec. 23, 1980

[54] RETRACTABLE GLOW PLUG FOR DIESEL ENGINE

[75] Inventors: Yutaka Matayoshi, Kamata-motomachi; Masayuki Tamura, Yokohama; Yoshiro Anegawa, Yokosuka, all of Japan

[73] Assignee: Nissan Motor Company, Limited, Yokohama, Japan

[21] Appl. No.: 4,204

[22] Filed: Jan. 17, 1979

[30] Foreign Application Priority Data

Feb. 24, 1978 [JP] Japan ..... 53/20639

[51] Int. Cl.[3] ..... F02B 9/08; F02P 19/02

[52] U.S. Cl. ..... 123/145 A; 123/254; 123/179 BG; 123/260

[58] Field of Search ..... 123/145 A, 179 H, 145 R, 123/32 C, 179 BG

[56] References Cited

U.S. PATENT DOCUMENTS 1,441,711 1/1923 Petter ..... 123/145 A

*Primary Examiner*—Tony M. Argenbright

[57] ABSTRACT

For use in a swirl-producing recombustion chamber of a Diesel engine, a glow plug comprises a shell which can be screwed into an engine block so as not to protrude into the precombustion chamber and a cylindrically shaped heating head attached to a plunger which is received in the shell and can be electromagnetically or hydraulically moved relative to the fixed shell. The heating head can be protruded from the shell so as to extend into a central region of the precombustion chamber when preheating of air is necessary but, at other times, can be retracted almost entirely into the shell so as not to obstruct violent swirling of air in the precombustion chamber.

9 Claims, 4 Drawing Figures

RETRACTABLE GLOW PLUG FOR DIESEL ENGINE

BACKGROUND OF THE INVENTION

This invention relates to a glow plug for a compression-ignition internal combustion engine having a swirl-producing precombustion chamber.

Diesel engines having a precombustion chamber to each engine cylinder generally utilize a glow plug to preheat air in the precombustion chamber in advance of fuel injection into the precombustion chamber at starting of the engine in a cold state, i.e. when the air can hardly be heated by compression to a temperature sufficient for reliable ignition of the injected fuel.

In many cases the precombustion chamber is formed as a swirl chamber to ignite fuel while air squeezed into the precombustion chamber is violently swirling thereby to attain efficient combustion in the main combustion chamber. To accomplish effective preheating of air in the swirl chamber at cold starting of the engine, the glow plug is screwed into an engine block such that a heater portion of the glow plug fully protrudes into the swirl chamber with its tip approximately in the middle of the swirl chamber.

The glow plug is utilized (energized) only at the start of the engine: at other times (during normal operation of the engine) the glow plug is kept unenergized. In other words, except at cold starting of the engine the glow plug is useless and because a nuisance to the function of the precombustion chamber. The heater portion of the glow plug offers an obstruction to the flow of air forced into the precombustion chamber and, furthermore, tends to cause weakening of the intensity of a swirl produced in the precombustion chamber. Failure in producing a sufficiently violent swirl of air in the swirl-producing precombustion chamber leads to an inefficient combustion in the main combustion chamber and will result in that the output of the engine remains on an insufficient level and that, particularly when exhaust gas recirculation is effected under high load operating conditions of the engine, the engine tends to emit black smoke.

SUMMARY OF THE INVENTION

It is an object of the present invention to provide a novel type of glow plug for a compression-ignition internal combustion engine having a swirl-producing precombustion chamber, which glow plug can achieve an effective preheating of air in the precombustion chamber at cold starting of the engine but, at other times, occupies only a negligible volume in the precombustion chamber and hence offers little obstruction to the production of a swirl of air in the precombustion chamber.

To accomplish this object, a glow plug according to the invention comprises a body which is adapted for fixed installation in the engine so as not to protrude into the precombustion chamber and formed therein with an elongate bore opening at one end of the body, a member movably received in the bore of the body, means for moving this member to vary the distance of the member from the aforementioned end of the body, a heating head of an elongate shape which is partly received in the bore of the body so as to longitudinally move relative to the body when the member in the body is moved, and seal means for preventing inflow of a gas into the body through the mentioned end thereof. The bore of the body, the movable member and the heating head are shaped and arranged such that the heating head protrudes almost entirely from the body when the movable member takes a first position relatively close to the aforementioned end of the body and retracts entirely or almost entirely into the body when the movable member takes a second position relatively remote from the same end of the body.

The means for moving the member in the body may be an electromagnet disposed in the body by utilizing the movable member as its iron core. Alternatively, a portion of the body may constitute a hydraulic cylinder by making the movable member as a piston.

As will be understood from the above stated construction, a glow plug according to the invention can achieve effective preheating of air in the swirl chamber at cold starting of the engine by making the heating head almost entirely protrude from the body. At other times, i.e. when there is no need of utilizing the glow plug, the heating head can be kept retracted into the bore in the body. In this state the heating head occupies practically no volume, or only a negligible volume, of the swirl chamber, meaning that the glow plug offers little obstruction to the flow of air forced into the swirl chamber and than an effective volume of the swirl chamber is increased. Accordingly the air can flow smoothly in the swirl chamber and can produce a violent swirl, whereby the engine can produce an improved output. Besides, the engine emits less smoke even when a relatively large amount of exhaust gas is recirculated.

DEESCRIPTION OF THE PREFERRED EMBODIMENTS

Figure 1:
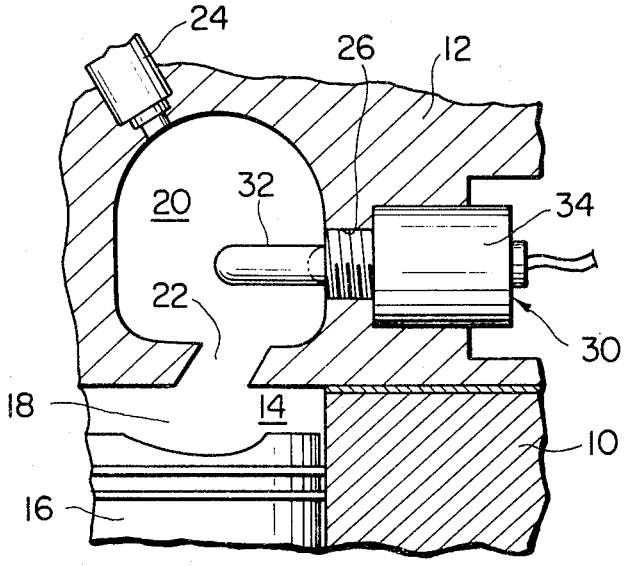
FIG. 1 is a schematic and sectional view of a combustion chamber of a compression-ignition internal combustion engine equipped with a glow plug.

In FIG. 1, reference numeral 10 indicates an engine block or cylinder block of a compression-ignition internal combustion engine assembled with another engine block or cylinder head 12. A reciprocating piston 16 is received in a cylinder bore 14 of the cylinder block 10 to define a main combustion chamber 18 between the bottom face of the cylinder head 12 and the top face of the piston 16. The cylinder head 12 is formed with a swirl chamber 20 as a pre-chamber to the main combustion chamber 18 and a cross-sectionally narrow aperture 22 through which the swirl chamber 20 communicates with the main combustion chamber 18. A fuel injection nozzle 24 opens into the swirl chamber 20. A glow plug 30 screwed into the cylinder head 12 has a generally cylindrical heating head 32 which protrudes into the swirl chamber 20 to such an extent that the tip portion of the heating head 32 reaches a central region of the swirl chamber 20. As an essential feature of the invention, the heating head 32 of the glow plug 30 is axially movable relative to a glow plug shell 34 (which is fixed to the cylinder head 12) such that, while preheating of air in the swirl chamber 20 is unnecessary, the heating head 32 can be retracted almost entirely into the shell 34 as will be described hereinafter with reference to FIGS. 2 and 3. In contrast, any of conventional glow plugs has a fixed heating head which remains in a definite position (such as the illustrated position of the heating head 32 in FIG. 1) in the swirl chamber 20 whether or not the preheating is necessary.

Figure 2:
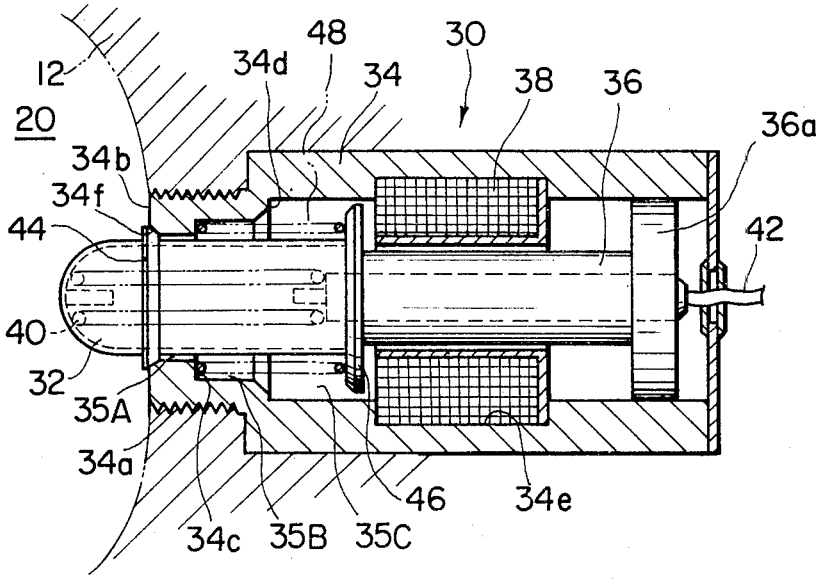
FIG. 2 is a longitudinal sectional view of a glow plug as an embodiment of the present invention.

Referring to FIG. 2, the shell or body 34 of the glow plug 30 according to the invention is a generally cylindrical and hollow member having a threaded end portion 34*a* so that the body 34 can be screwed into the cylinder head 12 without protruding into the swirl chamber 20. The space in the body 34 has the shape of a stepped cylinder. The diameter of this space is smallest in its endmost portion 35A, which is in the threaded portion 34*a* and gives an open end or annular end face 34*b* to the body 34, such that an annular shoulder 34*c* is formed at an end of an intermediate portion 35B of the space adjacent the endmost portion 35A. In the remaining portion 35C, the interior space has a still larger diameter so that another annular shoulder 34*d* is formed at the boundary of the two cylindrical spaces 35C and 35B.

A generally cylindrical member 36 which serves as the iron core of an electromagnet is coaxially disposed in the widest portion 35C of the space in the body 34, and a magnet coil 38 is fixedly disposed in this space 35C by utilizing, for example, an annular depression 34*e* formed on the inside of the body 34 so as to surround the core member 36. Proper disposition of the core member 36 may be ensured by the provision of a flange 36*a* which fits slidably into the cylindrical space 35C. The generally cylindrical heating head 32 has an outer diameter slightly smaller than the diameter of the endmost portion 35A of the space in the body 34 and is longitudinally mounted on one end of the core member 36 so as to pass through the endmost portion 35A of the space. The heating head 32 comprises therein a heater coil 40 with leads 42 connected thereto through the interior of the core member 36. (Leads to the magnet coil 38 are omitted from the illustration.) At a short distance from the tip, the heating head 32 has an annular seal valve 44 in the form of a brim. This seal valve 44 is larger in diameter than the endmost portion 35A of the space in the body 34 and hence remains out of the body 34. The inner periphery 34*f* of the annular end face 34*b* of the body 34 is chamfered so as to provide a valve seat for the seal valve 44. In the widest portion 35C of the space in the body 34, the heating head 32 has another annular and brim-like seal valve 46 which is larger in diameter than the intermediate portion 35B of the space. The annular shoulder 34*d* at the end of the cylindrical space 35C is so chamfered as to serve as a valve seat for this seal valve 46. The distance between the two seal valves 44 and 46 (this distance determines the length of the heating head 32) is such that the inner seal valve 46 is fairly distant from the shoulder 34*d* when the outer seal valve 44 rests on the valve seat 34*f* to close the open end 34*b* of the body 34. In other words, when the inner seal valve 46 comes into contact with the shoulder 34*d* by an axial movement of the core member 36, a major portion of the heating head 32 protrudes from the open end 34*b* of the body 34. The distance between the two seal valves 44 and 46 and the total length of the two cylindrical spaces 35A and 35B are determined such that a tip portion of the heating head 32 reaches a central region of the swirl chamber 20 when the inner seal valve 46 rests on the shoulder or valve seat 34*d*.

The magnet coil 38 and the core member 36 are arranged such that the core member 36 moves toward the open end 34*b* of the body 34 when an excitation current flows through the coil 38. A compression spring 48 is installed in the space in the body 34 by utilizing the shoulder 34*c* so as to bias the inner seal valve 46 towards the magnet coil 38. This spring 48 serves as a return spring to retract the heating head 32 into the body 34 upon interruption of an excitation current to the magnet coil 38. Leakage of either air or combustion gas from the swirl chamber 20 through this glow plug 30 is prevented by either of the two seal valves 44 and 46: by the outer one 44 while the heating head 32 is in the retracted state and by the inner one 46 while the head 32 is in the protruded state. (In the latter case, the inner seal valve 46 is pressed against the valve seat 34*d* by the core member 36.)

Figure 3:
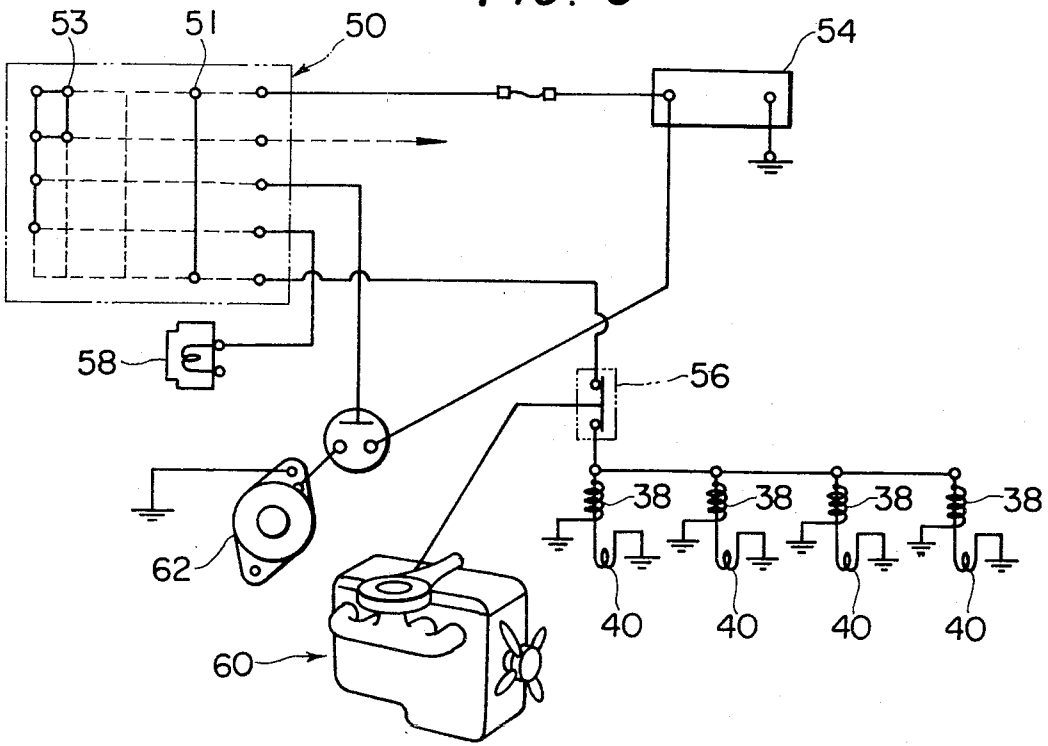
FIG. 3 is a circuit diagram showing the manner of controlling the function of the glow plug of FIG. 2 used in a compression-ignition internal combustion engine.

Referring to FIG. 3, an engine key switch 50 for a Diesel engine 60 provided with the glow plug 30 of FIG. 2 for each engine cylinder comprises glow contacts 51 and starter contacts 53. Both the heater coil 40 and the magnet coil 38 of each glow plug 30 are connectable to a battery 54 via the glow contacts 51 of the engine key switch 50. A temperature-responsive switch 56 to detect the temperature of the engine block 12 (the temperature may be represented by the cooling water temperature) is interposed between the glow contacts 51 and the glow plugs 30 to break the connection of the glow plugs 30 with the glow contacts 51 while the engine temperature is above a predetermined level such as the 15°–20° C. level. Indicated at 58 is a pilot lamp which is lighted while the glow contacts 51 are closed. The starter contacts 53 can be closed to connect a starter motor 62 to the battery 54 while the glow contacts 51 are left open.

At cold starting of the engine 60, i.e. in the case of starting the engine 60 when the temperature of the engine block 12 is, for example, below about 15° C., the engine key switch 50 is operated first to close the glow contacts 51. Then an excitation current is applied to the magnet coil 38 of each glow plug 30, resulting in that the core member 36 moves towards the open end 34*b* of the shell 34 to thrust out the heating head 32 against the force of the spring 48 until the inner seal valve 46 comes into contact with the shoulder 34*d*, i.e. until the tip of the heating head 32 reaches a central region of the swirl chamber 20. At the same time a current flows through the heating coil 40 in the heating head 32, so that there occurs a gradual rise in the temperature of air in the swirl chamber 20. In this state, the inner seal valve 46 pressed against the valve seat 34*d* prevents leakage of air from the swirl chamber 20 through the glow plug 30.

After the lapse of a time period required for heating of air in the swirl chamber 20 to a temperature sufficient for reliable ignition of fuel, the engine key switch 50 is operated to open the glow contacts 51 and instead close the starter contacts 53. Then the starter motor 62 is put into action to move the piston 16. At the end of a compression stroke, the fuel injection nozzle 24 injects fuel into the heated and compressed air in the swirl chamber 20 followed by spontaneous ignition of the injected fuel. The switchover of the key switch 50 from the glow contacts 51 to the starter contacts 53 results in the break of the connection between the glow plug 30 and the battery 54. Accordingly the heating head 32 is retracted into the body 34 by the force of the return spring 48 upon actuation of the starter motor 62, and at the same time the application of the heating current to the heater coil 40 is interrupted.

The heating head 32 in the retracted state offers little obstruction to the flow of air in the swirl chamber 20, so that a desirably violent swirl of air can be produced at each compression stroke after the retraction of the heating head 32.

In the case of starting the engine 60 in a warm or heated state (for example, when the ambient temperature is above about 20° C.) there will be no need of utilizing the glow plug 30. In such a case the temperature-responsive switch 56 keeps the glow plug 30 disconnected from the battery 54 irrespective of the state of the key switch 50.

When starting the engine 60 in an exceedingly cold state (for example, when the ambient temperature is below about −20° C.), it may be difficult to achieve a sufficient heating of air in the swirl chamber 20 by keeping the glow plug 30 in action only in advance of the actuation of the starter motor 62. In preparation for such a low temperature condition, the electrical circuit of FIG. 3 may be modified so as to keep the heating head 32 in the protruded and heated state for a certain period of time after closing of the starter contacts 53.

Figure 4:
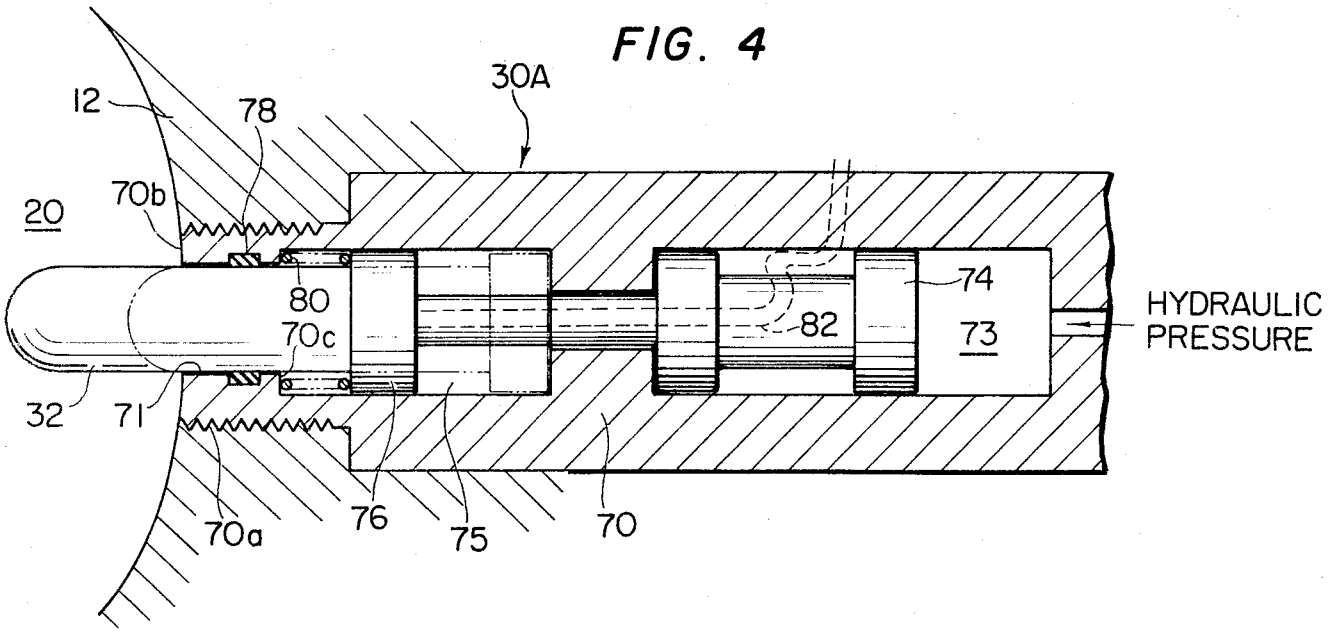
FIG. 4 is a longitudinal sectional view of a glow plug as another embodiment of the invention.

FIG. 4 shows a glow plug 30A as another embodiment of the invention. As a principal difference from the glow plug 30 of FIG. 2, this glow plug 30A utilizes a hydraulic pressure to temporarily protrude the heating head 32 from a glow plug shell 70.

The shell or body 70 is a generally cylindrical member which is axially bored and has a threaded end portion 70*a* adjacent an open end 70*b* such that the body 70 can be screwed into the cylinder heat 12 without protruding into the swirl chamber 20. The heating head 32 of this glow plug 30A is fundamentally similar to that of the glow plug 30 in FIG. 2. In the threaded end portion 70*a*, an endmost portion 71 of the bore of the body 70 has such a diameter as allows the cylindrical heating head 32 to slidably pass therethrough. The other end portion of this body 70 constitutes a hydraulic cylinder 73 comprising a piston 74. In the illustrated case, the body 70 is formed with a cylindrical damper chamber 75 adjacent the endmost portion 71 of the bore in the body 70, and an end portion of the piston 74 can protrude into this chamber 75. The diameter of the damper chamber 75 is such that an annular shoulder 70*c* is formed at the boundary of this chamber 75 and the endmost space 71. A cylindrical member 76 is slidably received in the damper chamber 75 and is joined to the piston 74. The heating head 32 is mounted longitudinally on this member 76 which can be regarded as part of the piston 74. In the endmost portion 70*a* of the body 70, an annular seal or packing 78 is retained in a groove formed in the cylindrical wall defining the space 71 to prevent outflow of hydraulic fluid from the body 70 and leakage of air or combustion gas from the swirl chamber 20 through the body 70. A return spring 80 is installed in the damper chamber 75 by utilizing the annular shoulder 70*c* to bias the cylindrical member 76 (and hence the piston 74) towards the primary portion of the hydraulic cylinder 73. Leads 82 to the heater coil in the heating head 32 pass through the piston 74.

At cold starting of the engine, a hydraulic pressure is applied to the hydraulic cylinder 73 of the glow plug 30A by means of a selector valve (not shown) to move the piston 74 towards the end face 70*b* of the body 70 whereby the heating head 32 is thrusted out of the body 70 until the spring 80 is fully compressed. The heating head 32 has such a length that in this state a tip portion of the heating head 32 reaches a central region of the swirl chamber. Simultaneously with application of hydraulic pressure to the cylinder 73, a current is applied to the heater coil in the heating head 32. After accomplishment of preheating of air in the swirl chamber 20, the hydraulic pressure in the cylinder 73 is reduced to allow the piston 74 to be pushed back by the force of the spring 80 acting on the cylindrical member 76. When the glow plug 30A has the damper chamber 75 as illustrated in FIG. 4, the piston 74 does not move abruptly upon interruption of the application of hydraulic pressure to the hydraulic cylinder 73. This is convenient for continuation of the preheating for a certain period of time after starting of the engine.

What is claimed is:

1. A glow plug for preheating of air in a swirl-producing precombustion chamber of a compression-ignition internal combustion engine, the glow plug comprising:

a body which is adapted for fixed installation in the engine substantially without protruding into the precombustion chamber and formed therein with an elongate bore opening at one end of said body;

an electromagnet constituted of a magnet coil stationarily disposed in said bore and a member which is movably received in said bore and serves as an iron core passing through said magnet coil, so that the distance of said member from said end of said body varies as said magnet coil is energized and deenergized;

a spring disposed in said bore to bias said member in an axial direction;

a heating head of an elongate shape fixed at one end thereof to said member and partly received in said bore of said body so as to longitudinally move relative to said body through said end of said body when said member is moved, said heating head comprising therein an electric heater wire; and seal means for preventing inflow of a gas into said bore through said end thereof;

said bore, said member, said spring, and said heating head being shaped and arranged such that a major portion of said heating head protrudes from said body when said magnet coil is energized to cause said member to take a first position relatively close to said end of said body and retracts into said body when said magnet coil is deenergized to allow said member to be brought to a second position relatively remote from said one end of said body by said spring.

2. A glow plug as claimed in claim 1, wherein said heater wire in said heating head is connected in parallel with said magnet coil such that a current flows through said heater wire when an excitation current flows through said magnet coil.

3. A glow plug as claimed in claim 2, wherein both said bore and said heating head are cross-sectionally circular, said seal means comprise an annular first seal member attached to the peripheral surface of said heating head at a short distance from a free end of said heating head such that said end of said body is closed by said first seal member when said member takes said second position and an annular second seal member attached to the peripheral surface of said heating head in an end portion always remaining in said bore, said bore being shaped to provide an annular valve seat on the inside thereof at such a location that said second seal member comes into intimate contact with said valve seat when said member takes said first position.

4. A glow plug for preheating of air in a swirl-producing precombustion chamber of a compression-ignition internal combustion engine, the glow plug comprising:

a body which is adapted for fixed installation in the engine substantially without protruding into the precombustion chamber and formed therein with an elongate bore opening at one end of said body;

a hydraulic cylinder which constitutes a portion of said body;

a member which is movably received in said bore and serves as a piston slidably received in said hydraulic cylinder, so that the distance of said member from said end of said body varies as said hydraulic cylinder is actuated and unactuated;

a spring disposed in said bore to bias said member in an axial direction;

a heating head of an elongate shape fixed at one end thereof to said member and partly received in said bore of said body so as to longitudinally move relative to said body through said end of said body when said member is moved, said heating head comprising therein an electric heater wire; and seal means for preventing inflow of a gas into said bore through said end thereof;

said bore, said member and said heating head being shaped and arranged such that a major portion of said heating head protrudes from said body when said hydraulic cylinder is actuated to cause said member to take a first position relatively close to said end of said body and retracts into said body when said hydraulic cylinder is unactuated to allow said member to be brought to a second position relatively remote from said one end of said body by said spring.

5. A glow plug as claimed in claim 4, wherein said hydraulic cylinder is provided with an electrically operated selector valve through which an actuating hydraulic pressure can be applied to said hydraulic cylinder, said heater wire in said heating head being electrically connected in parallel with said selector valve such that a current flows through said heater wire when an actuation current is applied to said selector valve to cause movement of said member from said second position to said first position.

6. A glow plug as claimed in claim 5, wherein a portion of said bore in said body constitutes a damper chamber associated with said hydraulic cylinder, said heating head being shaped in an endmost portion including said one end thereof to serve as a piston received in said damper chamber so as to increase the volume of said damper chamber when said heating head protrudes from said body.

7. A system for preheating air in a swirl-producing precombustion chamber of a compression-ignition internal combustion engine, the system comprising:

a glow plug comprising a body which is fixed in the engine so as to be exposed at one end thereof to the precombustion chamber substantially without protruding into the precombustion chamber and formed therein with an elongate bore opening at said one end of said body into the precombustion chamber, a member movably received in said bore of said body, electrically-actuatable means for moving said member to vary the distance of said member from said one end of said body, a heating head of an elongate shape fixed at one end thereof to said member and partly received in said bore so as to longitudinally move relative to said body through said end of said body when said member is moved, said heating head comprising therein an electric heater wire, and seal means for preventing leakage of gases from the precombustion chamber through said body, said bore, said member and said heating head being shaped and arranged such that a major portion of said heating head protrudes from said body so that a protruded endmost portion of said heating head reaches a central region of the precombustion chamber when said member takes a first position relatively close to said one end of said body and retracts into said body when said member takes a second position relatively remote from said one end of said body; and switching means for selectively establishing and breaking both a first circuit for actuating said electrically actuatable means and a second circuit to energize said heater wire such that said first and second circuits are simultaneously established prior to starting of the engine.

8. A system as claimed in claim 7, wherein said electrically actuatable means comprise an electromagnet constituted in said body by utilizing said member as an iron core of said electromagnet, said glow plug further comprises a spring disposed in said bore to bias said member in such a direction that said member is brought to said second position when said electromagnet is energized.

9. A system as claimed in claim 7, wherein said electrically actuatable means comprise a hydraulic cylinder which constitutes a portion of said body and is provided with an electrically operated selector valve through which an actuating hydraulic pressure can be applied to said hydraulic cylinder, said member being made as a piston slidably received in said hydraulic cylinder, said glow plug further comprises a spring disposed in said member in such a direction that said member is brought to said second position while said hydraulic cylinder is unactuated.

* * * * *